US008038233B2

(12) United States Patent
Pezzoni

(10) Patent No.: US 8,038,233 B2
(45) Date of Patent: Oct. 18, 2011

(54) DEVICE FOR SUPPORTING GLASS PANELS IN A SUBSTANTIALLY PERPENDICULAR POSITION TO EACH OTHER

(75) Inventor: Danilo Pezzoni, Giussano (IT)

(73) Assignee: Gruppo Confalonieri S.p.A. (IT)

( * ) Notice: Subject to any disclaimer, the term of this patent is extended or adjusted under 35 U.S.C. 154(b) by 918 days.

(21) Appl. No.: 11/873,820

(22) Filed: Oct. 17, 2007

(65) Prior Publication Data

US 2008/0093527 A1 Apr. 24, 2008

(30) Foreign Application Priority Data

Oct. 18, 2006 (EP) ..... 06425713

(51) Int. Cl.
*A47F 3/00* (2006.01)

(52) U.S. Cl. ..... 312/140; 312/138.1

(58) Field of Classification Search ..... 411/427; 403/231, 256, 258, 403; 312/140, 114, 257.1, 312/263, 138.1, 265.5, 265.6
See application file for complete search history.

(56) References Cited

U.S. PATENT DOCUMENTS

| | | | | | |
|---|---|---|---|---|---|
| 926,374 | A | * | 6/1909 | Wright | 312/140 |
| 1,758,843 | A | * | 5/1930 | Lizotte | 403/219 |
| 3,563,581 | A | * | 2/1971 | Sommerstein | 403/217 |
| 3,658,035 | A | * | 4/1972 | Harris | 119/269 |
| 3,998,509 | A | | 12/1976 | Hauser | |
| 4,301,636 | A | * | 11/1981 | Luria | 312/111 |
| 4,731,973 | A | * | 3/1988 | Stenemann | 52/767 |
| 6,530,627 | B2 | * | 3/2003 | Elmer | 312/140 |
| 2005/0260865 | A1 | * | 11/2005 | Rehbein | 439/15 |

FOREIGN PATENT DOCUMENTS

| | | | |
|---|---|---|---|
| DE | 3606276 | * | 9/1987 |
| DE | 94 07 825 | U1 | 7/1994 |
| DE | 200 06 395 | U1 | 6/2001 |
| DE | 298 24 718 | U1 | 6/2002 |
| GB | 354 055 | A | 8/1931 |
| WO | WO 89/06507 | A | 7/1989 |

* cited by examiner

*Primary Examiner* — Janet M Wilkens
(74) *Attorney, Agent, or Firm* — Akerman Senterfitt

(57) ABSTRACT

A device for supporting glass panels in a substantially perpendicular position to each other. The device includes a block having a plate intended for gluing to a respective glass panel, at least one structurally separate right-angled element having a plate intended for gluing to a respective panel and a fixing device for adjustable fixation of the at least one right-angled element to said the block.

22 Claims, 13 Drawing Sheets

DEVICE FOR SUPPORTING GLASS PANELS IN A SUBSTANTIALLY PERPENDICULAR POSITION TO EACH OTHER

FIELD OF APPLICATION

In its more general aspect, the present invention relates to the technical sector of furniture manufacturing with particular reference to the construction of furniture units having a frame composed of glass panels, such as in show cases and similar items.

In particular, the present invention relates to a connecting device for supporting glass panels in a substantially perpendicular position to each other.

PRIOR ART

It is well known that the construction of furnishing units with a glass frame, such as show cases and similar items, involves the connection of glass panels preformed in the required sizes, in a perpendicular position to each other to create said frame.

This is obtained by means of devices, which connect the glass panels positioned perpendicular to each other, that are attached in the zones that form the corners of the frame.

Said devices are commonly designed and produced to provide both the rest or contact between the panels positioned perpendicular to each other, as well as an adequate support in order to maintain said panels in a perpendicular position to each other.

One type of contact and support device basically involves a plurality of right-angled metal elements attached to the glass panels in a perpendicular position to each other, by means of fixing screws inserted through suitable holes previously drilled in said panels.

However, these devices exhibit the disadvantage of having to drill holes in the glass, an operation that is sometimes difficult and that requires highly specialized personnel.

Another more recent type of contact and support device for glass panels involves a pair of, structurally separated metal elements, that are associated by rotation on a pin, each element being equipped with a plate devised for fixation to a respective panel with adhesive.

The fixing operations basically require the application of adhesive on the metal element plates, followed by the application of said metal elements to the panels maintained separate from one another, and lastly, the hardening of the adhesive by subjecting it to ultraviolet beams from a suitable source such as a UV lamp.

Although advantageous under certain aspects, in particular in that hole drilling in the glass panels is not necessary, said devices exhibit the drawback that the gluing operations must be performed with great precision, an operation made even more difficult because of the complete lack of a reference point with the adjacent panel, not yet installed, therefore requiring the need for previous positioning of the panels, and maintaining said panels and their respective plates in the required position using special alignment template devices which must be modified according to the different sizes of the panels.

The problem linked with positioning precision is particularly critical in that, for existing devices, no efficient system has been provided to adjust play during assembly, in order to correct inevitable reciprocal positioning error between plates and panels.

Therefore it follows that the installation of said contact and support devices is complicated and costly and requires highly specialized personnel.

The technical problem underlying the present invention is that of providing a device for supporting glass panels in a substantially perpendicular position to each other that overcomes the aforesaid drawbacks with reference to the prior art cited above.

SUMMARY OF THE INVENTION

This problem is solved by a device for supporting glass panels in a substantially perpendicular position to each other as described in claim 1 and followings.

In particular said technical problem is solved by a device for supporting glass panels in a substantially perpendicular position to each other comprising a block having a plate intended to be glued to a respective glass panel, at least one structurally separated right-angled element having a plate intended to be glued to a respective panel and means for the adjustable fixation of said at least one right-angled element on said block.

Further characteristics and advantages of the device for supporting glass panels according to the invention will be made more apparent from the following description of some preferred embodiments thereof, said description being provided as a non-limitative examples with reference to the appended figures.

DETAILED DESCRIPTION

Figure 1:
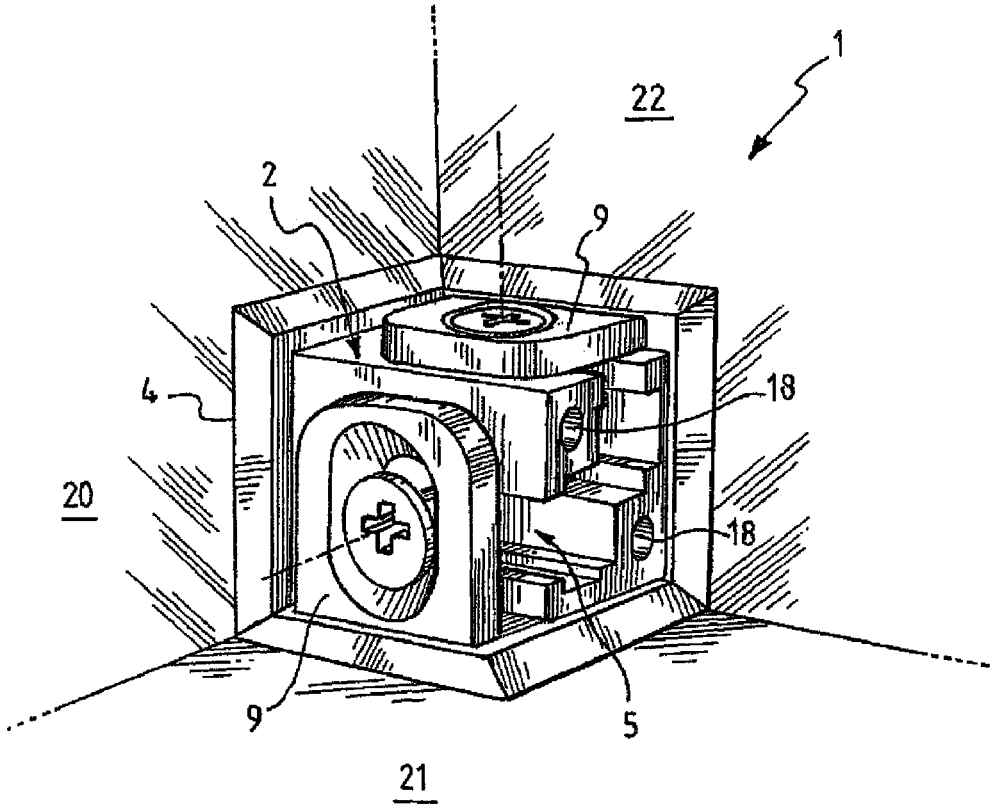
FIG. 1 shows a perspective view of a device according to an embodiment of the invention for the support of glass panels, said device being illustrated without the cover element.

With reference to FIGS. 1-5, a device for the support of glass panels in a substantially perpendicular position to each other, according to a first embodiment of the invention, is identified throughout by the numeral 1.

The support device 1 comprises a block in a metal material having a turret 3 terminating at one end with a plate 4. The turret 3 contains a hollow cavity 5, open at the rear, that is, at the side opposite to plate 4, and laterally on two sides at right angles to each other, through openings 6 which extend in a longitudinal direction.

The device 1 also comprises a pair of right-angled elements 7, structurally separated from one another, and from the block 2, each one having a plate 8 mounted with an appendix 9 set in a right-angled position. Each appendix 9 has an elongated slot 10 through which the shank 11 of a fixing screw 12 is inserted. Said fixing screw 12 is associated with a corresponding nut 13 that slides along a longitudinal guide 14, configured in the hollow cavity 5 under an opening 6, for the fixing of the respective right-angled element 7 to the turret 3 of block 2.

Figure 2:
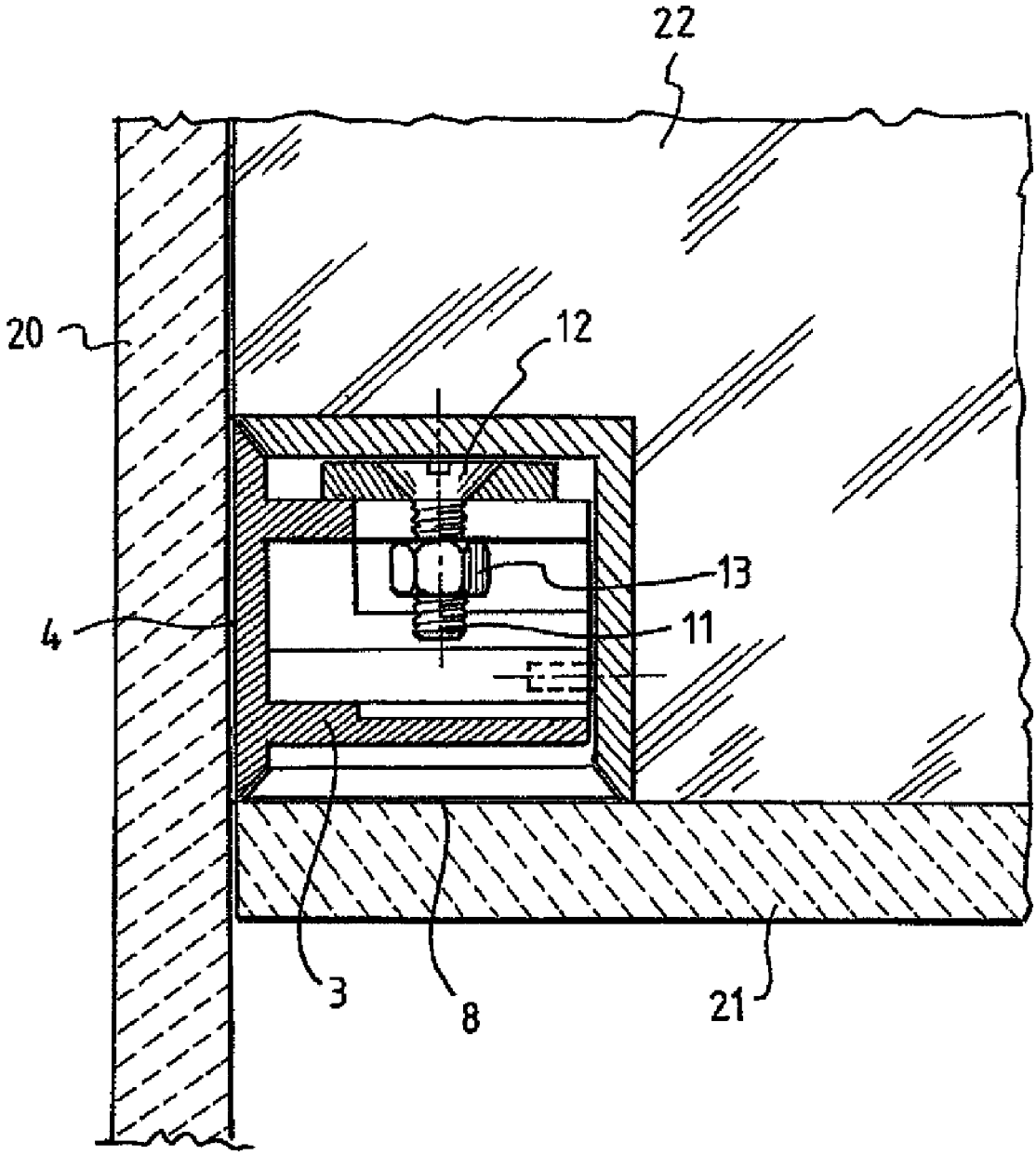
FIG. 2 shows a cross-section of the device in FIG. 1.
Figure 3:
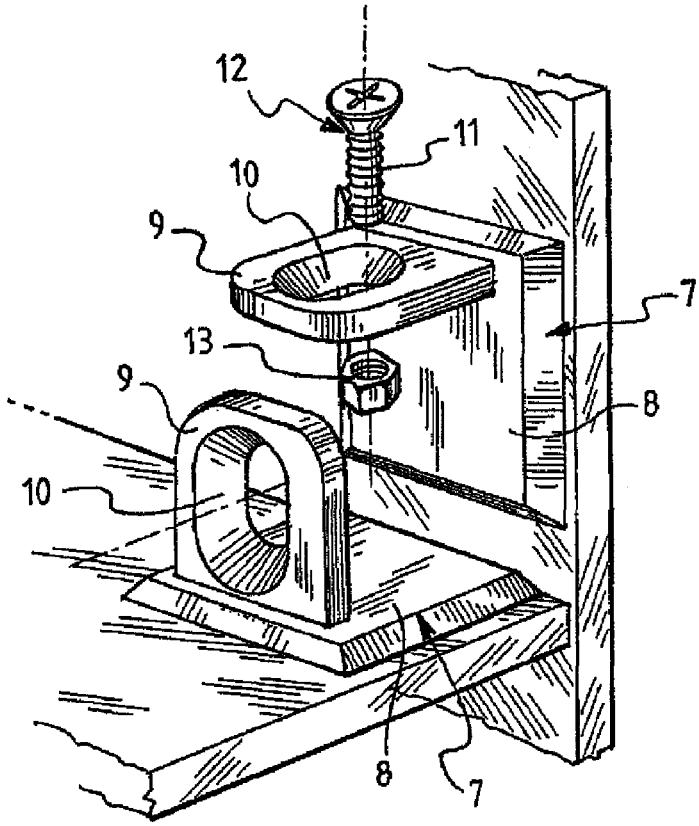
FIG. 3 shows an exploded perspective view of a detail of the device shown in FIG. 1.
Figure 4:
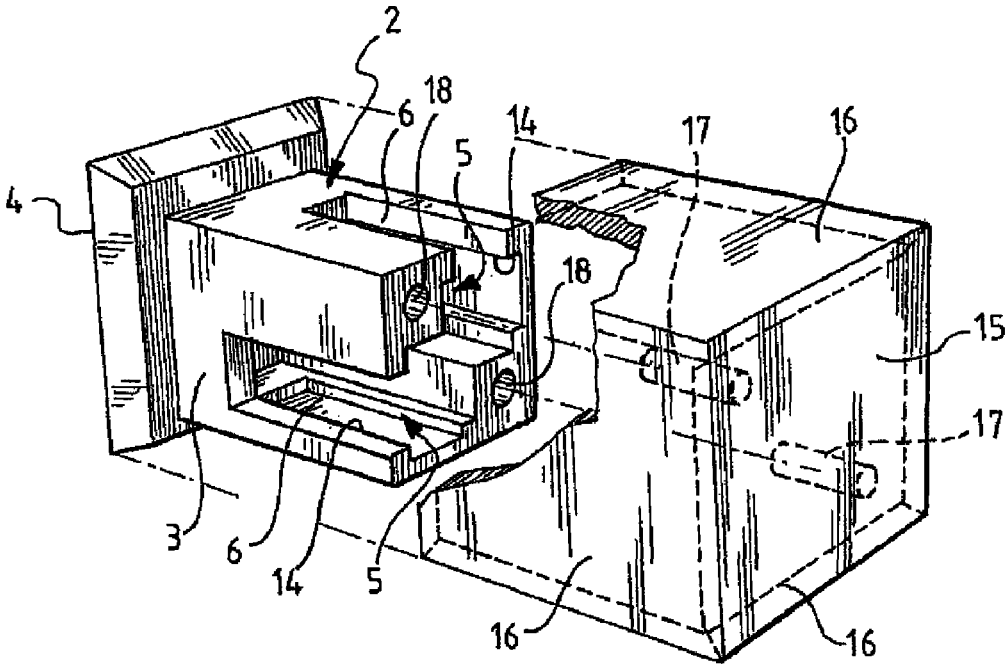
FIG. 4 shows an exploded perspective view of another detail of the device shown in FIG. 1, including the cover element.
Figure 5:
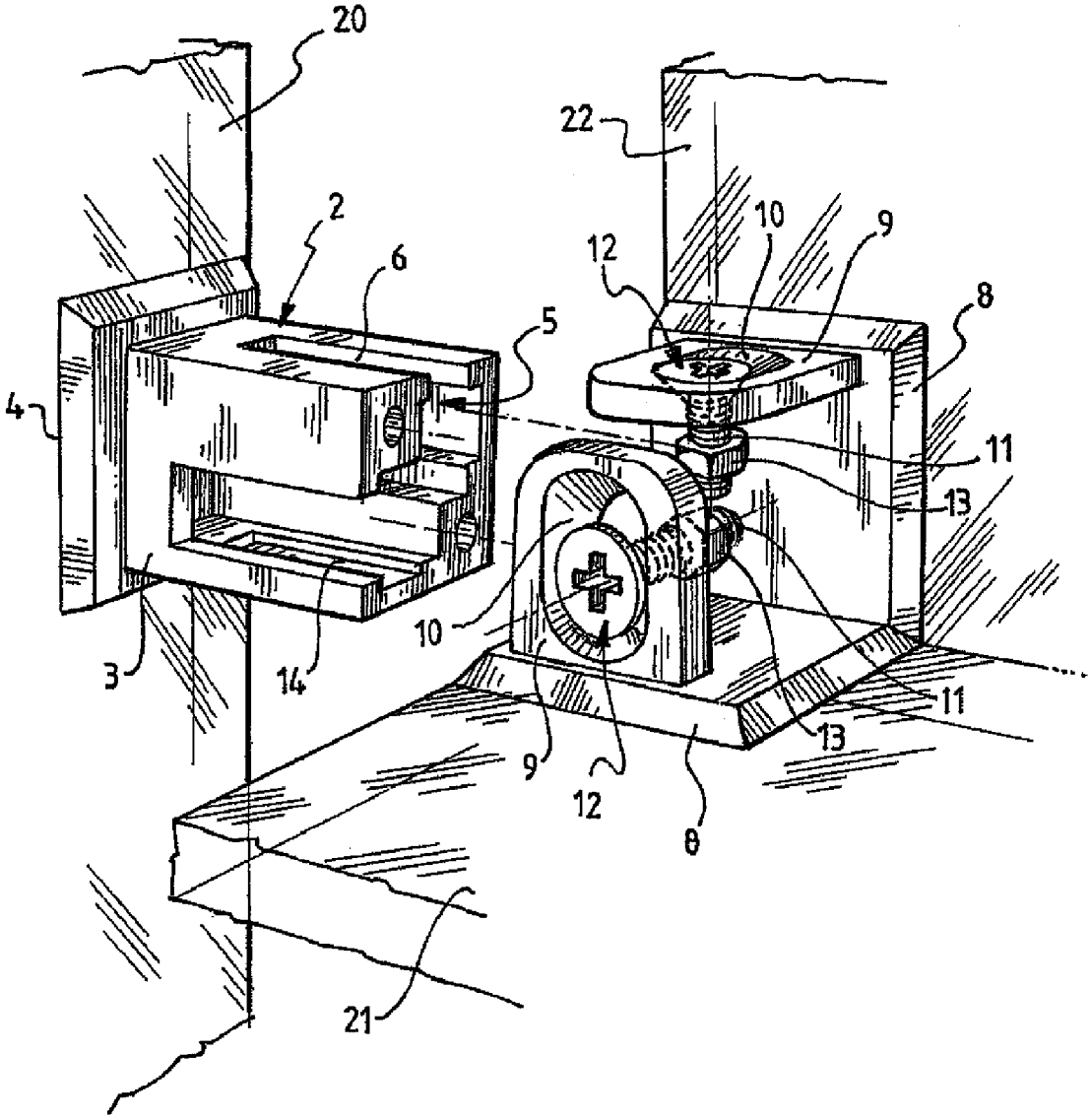
FIG. 5 shows an exploded perspective view of the device shown in FIG. 1 during an assembly stage.

In this manner, in the assembled configuration of device 1, as shown in FIGS. 1 and 2, the right-angled elements 7 are blocked with their appendixes 9 on the respective sides of the turret 3 having an opening 6, while the plates 8 of said right-angled elements extend along the respective sides of the turret 3 having no openings, in a substantially right-angled position with each other and with the plate 4 of block 2.

Preferably, the block and the right-angled elements 7 are manufactured in a metal material, in particular, stainless steel, or some easily mouldable material such as zama, aluminum or similar product.

In accordance with one aspect of the present invention, the fixing position of each right-angled element 7 on block 2 can be advantageously adjusted in two substantially perpendicular directions (longitudinal and transversal directions with reference to the longitudinal extension of the turret 3) by loosening the fixing screws 12 in order to slide the appendixes 9 in the sliding direction of the nuts 13 along the longitudinal guides in the turret 3, and/or to slide the appendixes 9 along the extension of the slot 10, followed by tightening again the fixing screws 12 until the shank 11 is blocked against a wall of the block 2 inside the hollow cavity 5.

The support device 1 also comprises a removable element 15 positioned to cover the turret 3, preferably in a plastic material to hide the view of the appendixes 9, of the right-angles elements 7, and the rear part of the turret 3. In particular, said cover element 15 comprises walls 16 that are substantially perpendicular to each other and a pair of pegs 17 formed integral to one of said walls 16, which are inserted in a removable manner into corresponding holes 18 formed on the rear face of the turret 3.

With regard to the installation of the connection device 1, the block 2 is fixed to a glass panel together with its respective plate 4, in the example, a side panel 20 or shoulder of the showcase. The fixing is performed by applying adhesive to the plate 4, then applying the block 2 with the plate 4 under pressure contact against a established area of the panel 20 and lastly hardening the adhesive by means of ultraviolet beams transmitted by a UV lamp, for example.

In a similar manner, but separately, the right-angled elements are glued with the plates 8 against the respective glass panels, in the example a lower panel 21 and a rear panel 22 respectively.

At this point, the glass panels 21 and 22 are rested, one at a time, in a position perpendicular to each other and to the panel 20, while providing to align and insert the nuts 13 with the respective screws 12 (suitably assembled previously) in the cavities 5 of the block 2. By tightening the screws 12, the right-angled elements 7 are then fixed to the block 2, thus maintaining panels 20, 21, and 22 in a substantially perpendicular position in relation to one another.

Advantageously, in the case of gluing inaccuracies of the of block 2 or the right-angled elements 7, or in the case of assembly imprecision, it is possible to at least partially adjust such inaccuracies/imprecision by loosening the fixing screws 12, then by sliding the appendixes 9 in the sliding direction of the nuts 13 along the longitudinal guides in the turret 3, and/or by sliding the appendixes 9 along the length of the slot 10, until the desired reciprocal position of the panels has been obtained, and then by tightening the screws 12 once more.

Figure 6:
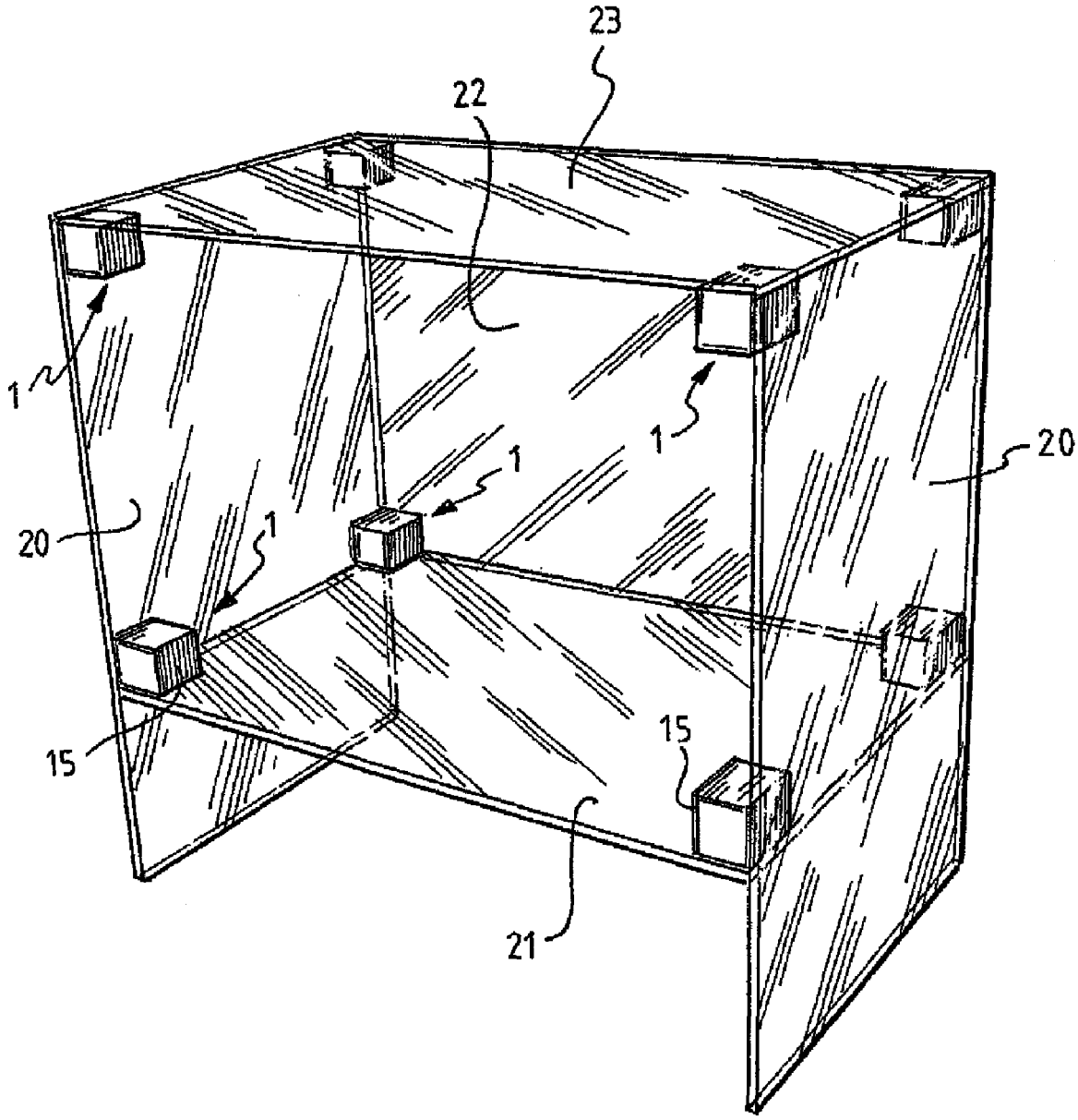
FIG. 6 shows an exploded perspective view of a portion of a show case comprising a plurality of devices as shown in FIG. 1, that connect glass panels in a position perpendicular to each other.
Figure 9:
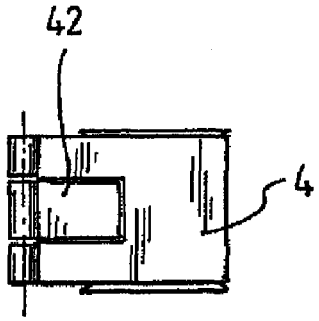
FIGS. 9 and 10 show respective side views of the device in FIG. 7, seen from different angles.
Figure 8:
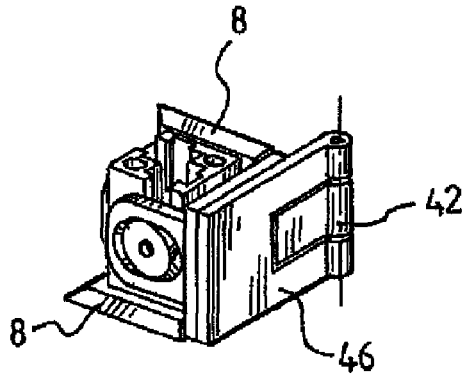
FIGS. 7 and 8 show respective perspective views with and without the cover element of a device according to another embodiment of the invention for the support of glass panels.
Figure 10:
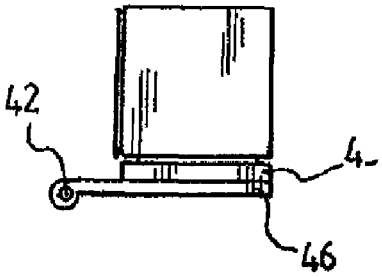
Figure 7:
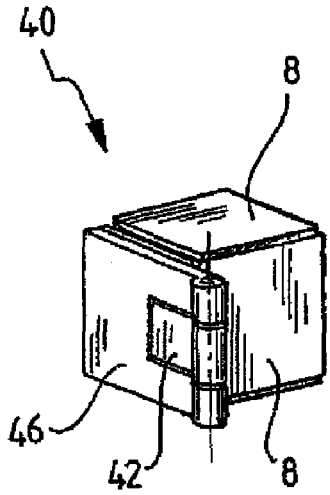

FIG. 6 shows a portion of showcase obtained by associating the side panels 20 with the upper panel 23, rear panel 22 and lower panel 21, by means of a plurality of devices 1 according to the invention.

It can be noted that these devices 1 not only provide the required support for the said panels, but they have also advantageously reduced dimensions and an attractive appearance also thanks to the presence of the cover 15 that hides the view all fixing elements.

With reference now to FIGS. 7-11, a device for supporting glass panels in a perpendicular position to each other according to another embodiment of the invention is described. This device is identified throughout by the numeral 40.

The elements of the devices described below which are structurally or functionally equivalent to one another and/or to corresponding elements of the aforesaid device 1, will be given the same reference numbers.

In comparison to device 1 described above, device 40 also comprises a hinge element, identified throughout by the numeral 41, comprising two plate-like wings pivoting around a pin 42. Said plate-like wings are composed of a first plate 43 fixed to a plate 4 of a turret 3, having a slot 44 for the insertion and guiding of the element 43 by means of a fixing screw 45, and a second plate 46 intended for gluing to a glass panel 25, such as a door of a show case, for example.

Figure 11:
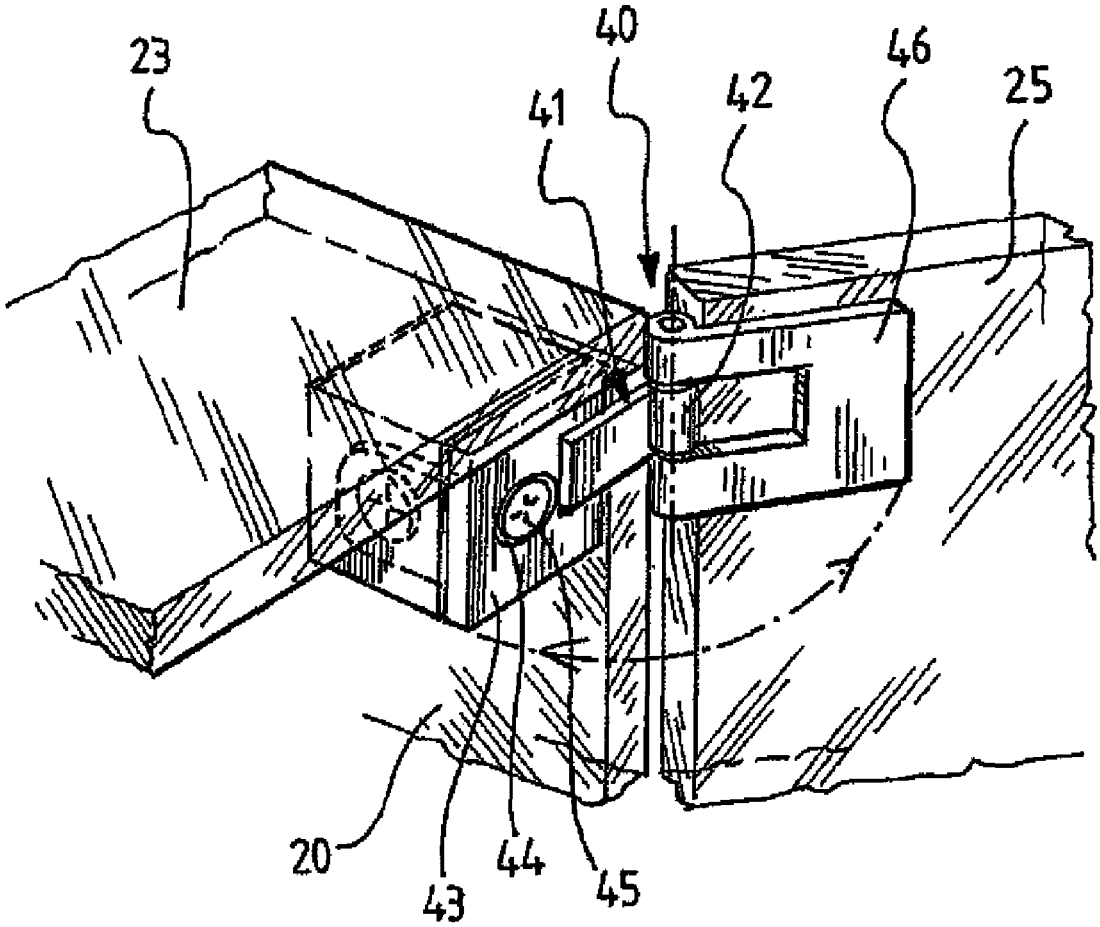
FIG. 11 shows a portion of a show case on which the device in FIG. 7 has been applied.
Figure 14:
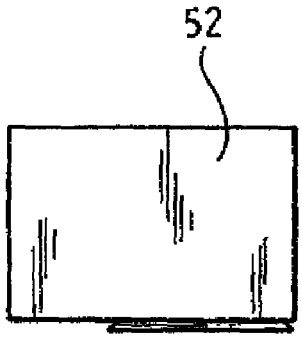
FIGS. 13 and 14 show respective side views of the device in FIG. 12 with its cover element, seen from different angles.
Figure 13:
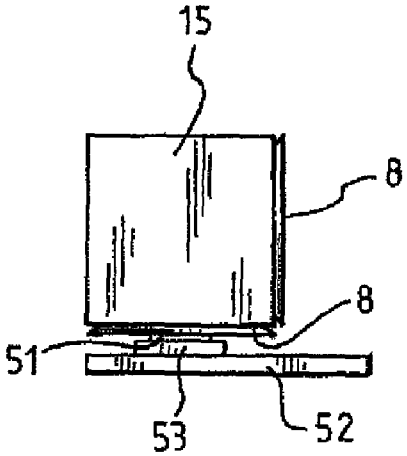
Figure 12:
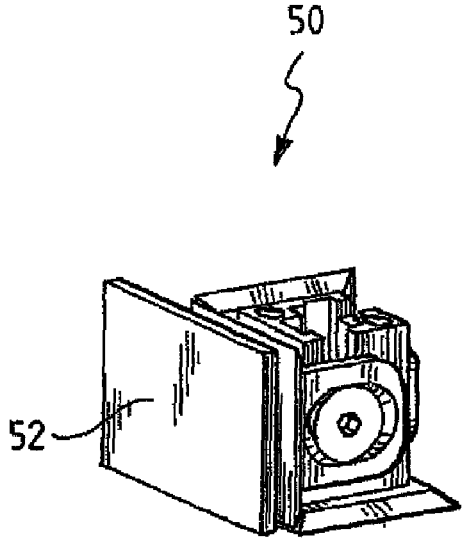
FIG. 12 shows a perspective view of a device according to a further embodiment of the invention for the support of glass panels; said device being shown without the cover element.

Said device 40 can be used in particular for supporting glass panels on the front of the show-case frame and similar furnishing items, in the example illustrated in FIG. 11, an upper panel 23 and a side panel 20, and at the same time a panel hinged to said frame, such as a glass panel 25 forming a door of the show-case.

With reference now to FIGS. 12-15, a device for supporting glass panels in a perpendicular position to each other according to another embodiment of the invention is described. This device is identified throughout by the numeral 50.

In comparison to the aforesaid device 1, the device 50 also comprises a magnetic element 51 fixed to a plate 4 of a turret 3 in a appropriate seat for the insertion of the magnet, and a metal plate 52 intended for fixation to a respective glass panel 25, the metal plate also having a hole 53 for the insertion of the magnetic element 51.

Figure 15:
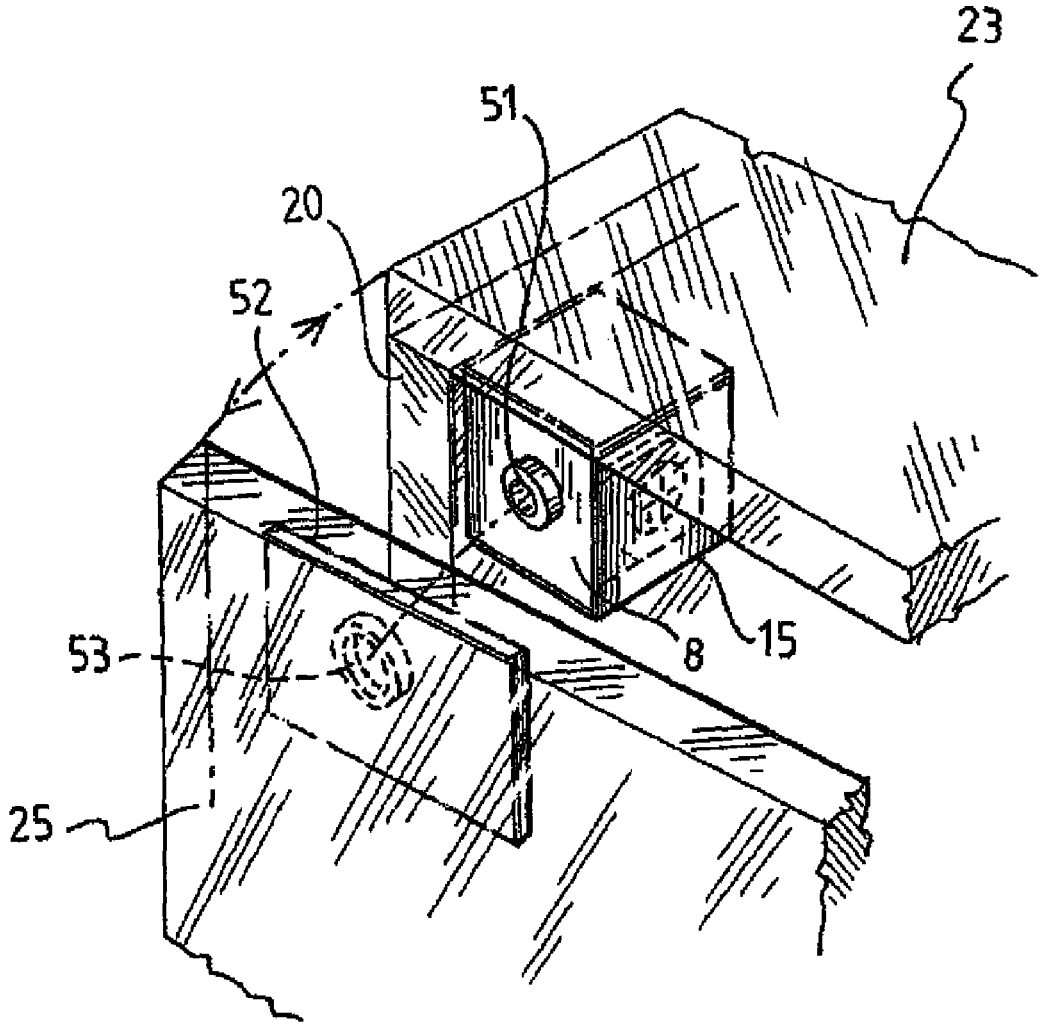
FIG. 15 shows a portion of a show case on which the device in FIG. 12 has been applied.
Figure 18:
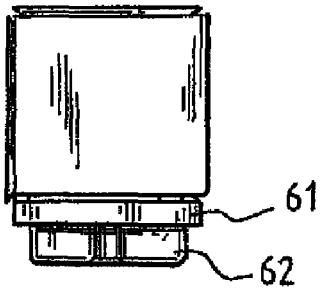
FIGS. 18 and 19 show respective side views of the device in FIG. 16 seen from different angles.
Figure 19:
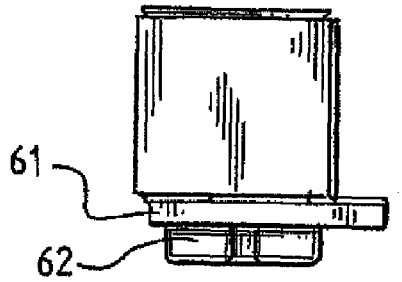
Figure 17:
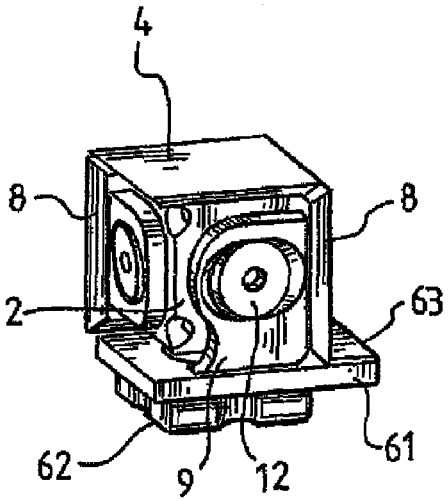
FIGS. 16 and 17 show respective perspective views with and without the cover element, of a device according to a further embodiment of the invention for the support of glass panels.
Figure 16:
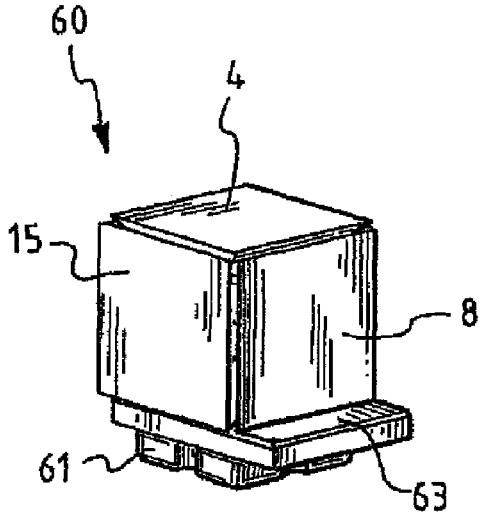
Figure 20:
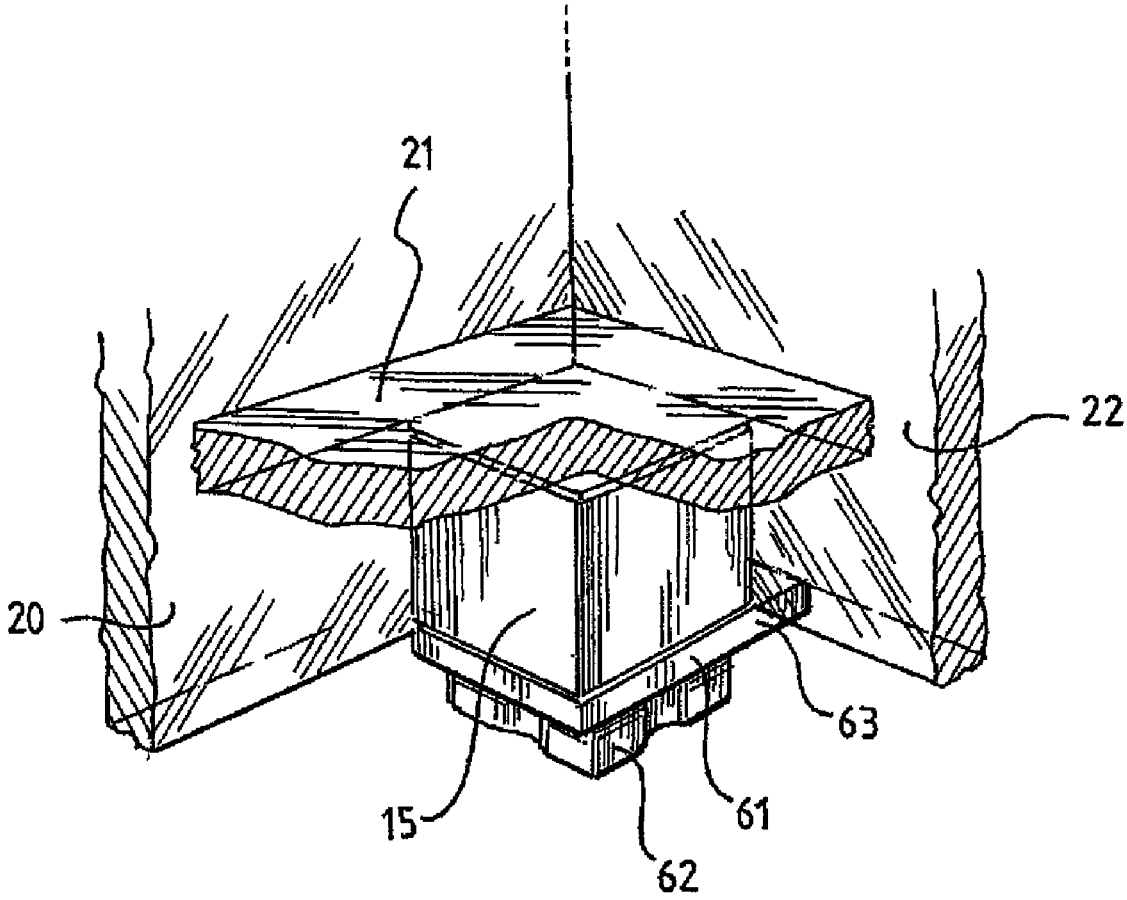
FIG. 20 shows a portion of a show case on which the device in FIG. 16 has been applied.
Figure 23:
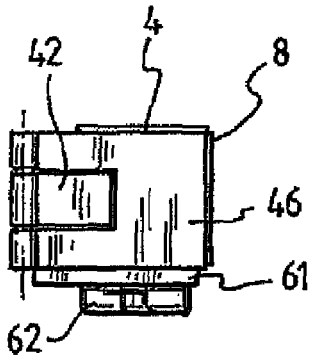
FIGS. 22, 23, and 24 show respective side views of the device in FIG. 21 with its cover element, seen from different angles.
Figure 24:
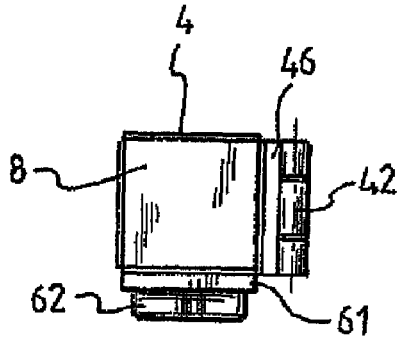
Figure 22:
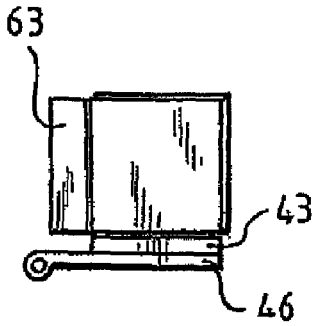
Figure 21:
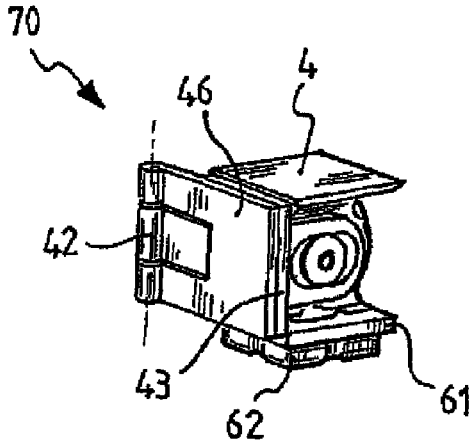
FIG. 21 shows a perspective view of a device according to a further embodiment of the invention for the support of glass panels; said device being shown without the cover element.
Figure 25:
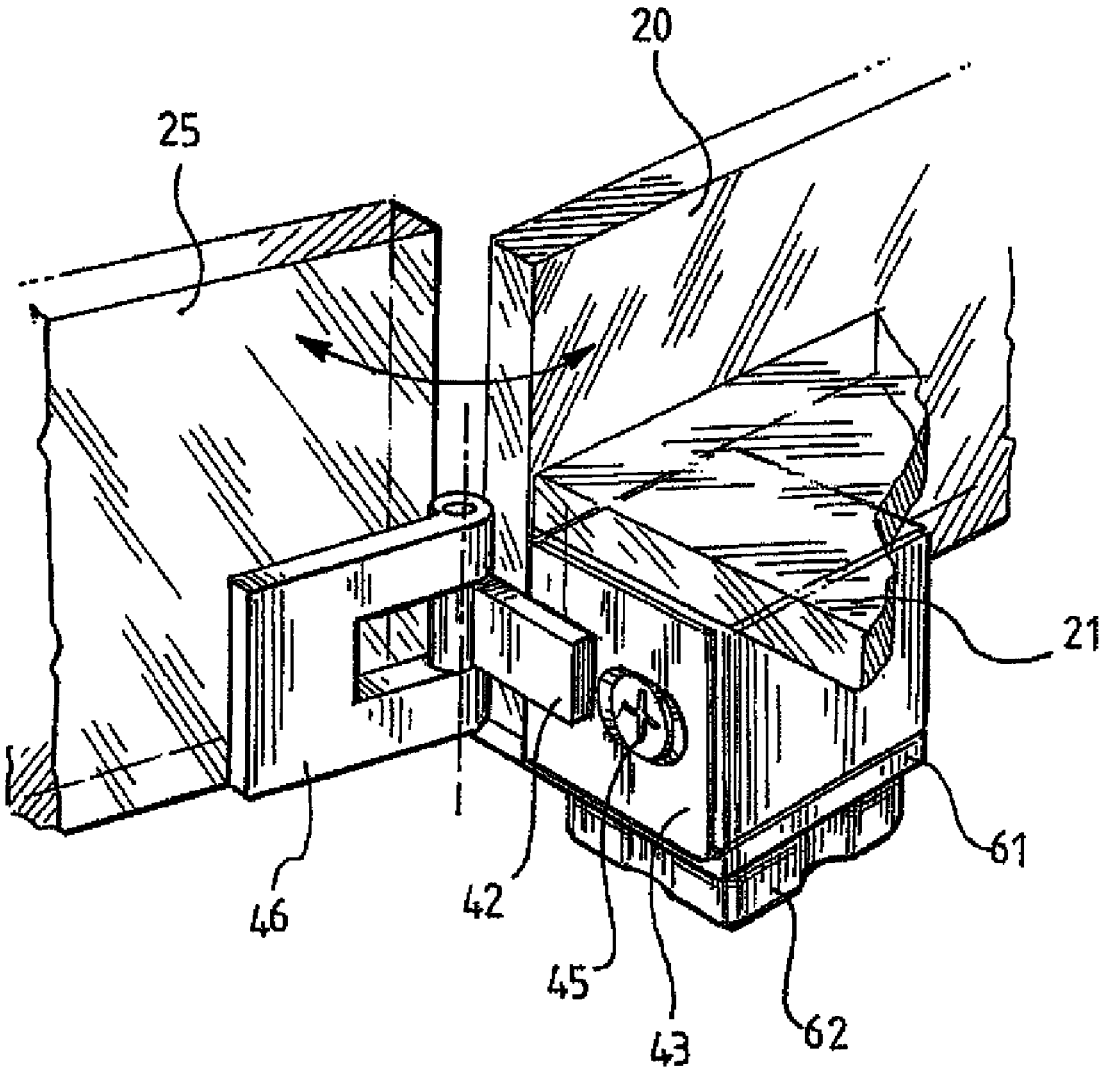
FIG. 25 shows a portion of a showcase on which the device in FIG. 21 has been applied.

Said device 50 can be used in particular for supporting glass panels on the front of the show-case frame and similar furnishing items, in the example illustrated in FIG. 15, an upper panel 23 and a side panel 20, and at the same time acting as a door handle to open the door, and as a door-block system, which maintains the hinged glass panel (such as the door 25) in closed position by means of the interaction between the magnetic element 51 and the plate 53, when said hinged panel is placed in contact against said upper panel 23 and said side panel 20.

With reference now to FIGS. 16-20, a device for supporting glass panels in a perpendicular position to each other according to another embodiment of the invention is described. This device is identified throughout by the numeral 60.

In comparison to the aforesaid device 1, the device 60 also comprises a base plate 61 formed integral to or fixed to the underside of a right-angled element 7, and a support foot 62 for floor contact, fixed to the base plate 61. The base plate 61 has an end portion 63 which extends out towards the plate 8 of said right-angled element 7, for advantageously allowing the support of a glass panel from the underside, in the example in FIG. 20, a rear panel 22 of a show-case (but this could equally be a side panel 20).

Preferably, the support foot 62 has a ribbed configuration to form the male element for insertion and fixing into suitable grooves of an extruded element, preferably in aluminum, positioned under said base plate 61. This element can be shaped and sized appropriately to create support feet providing variable height as required and attached as a projecting fixture on the element 60.

The device 60 can be used in particular for supporting glass panels at the lower part of a showcase frame and similar furnishing items, and act as support feet on the flooring.

With reference to FIGS. 21-25, a device for supporting glass panels in a perpendicular position to each other according to another embodiment of the invention is described. This device is identified throughout by the numeral 70.

The device 70 is characterized in that it comprises a hinge element, identified throughout by the numeral 41, fixed to a plate 8 by means of a right-angled element 7, in a manner similar to that described above in reference to device 40, and a support foot 62 fixed to the base plate 61, connected to the other right-angled element 7, in a manner similar to that described above in reference to device 60.

Said device 70 can be used in particular for supporting glass panels on the lower front of the show-case frame and similar furnishing items, performing both the functions of a support foot and of a support for a hinge panel (such as the door 25).

The main advantage of the device for supporting glass panels lies in the possibility of recovering any gluing imprecision of the block or of the right-angled elements to the respective panels and/or any assembly imprecision, by simply adjusting the fixing of the right-angled elements in relation to the block. It is to be noted advantageously that each right-angled element of the device according to the invention can be adjusted in two substantially perpendicular directions.

Another advantage of the device according to the invention lies in its capacity to support relatively thick glass panels (6-8 mm for example).

A further advantage of the device according to the invention lies in its reduced dimensions and versatility of use with panels accomplishing very different functions and requirements. In addition, its aspect when completely assembled (cube shape), without any protruding parts, provides the device according to the invention with a particularly attractive appearance.

The last advantage of the device according to the invention, no less important than the previous ones, lies in its easy of construction, making large-scale production possible at reduced cost.

Those skilled in the art will be able to make numerous modifications and variations to the aforesaid device according to the invention, while remaining within the scope of protection as described in the following claims.

I claim:

1. A device for supporting glass panels in a substantially perpendicular position to each other, the device comprising:

a block having a plate intended to be glued to a first glass panel;

two structurally separate right-angled elements, each having respective plates that are substantially perpendicular to one another and to said plate of the block, for supporting three glass panels in a substantially perpendicular position to each other; and means for adjustable fixation of said right-angled elements to said block.

2. The device according to claim 1, wherein said block comprises a turret terminating at one end with said plate and having an internal hollow cavity open at the rear and laterally on two sides perpendicular to each other through openings extending longitudinally.

3. The device according to claim 1 further comprising a hinged element comprising two wing plates pivoting on a pin, wherein a first wing plate is fixed to the respective plate of at least one said block or right angled element and a second wing plate is intended for gluing to a respective glass panel.

4. The device according to claim 3, wherein said first wing plate includes a slot for the insertion and adjustment of the first wing plate on the respective plate of the block or right angled element by means of a fixing screw.

5. The device according to claim 1, further comprising a magnetic element fixed to the respective plate of said block or right angled element in an appropriate seat, and a metal plate intended for fixation to a respective glass panel, said metal plate also having a hole for the insertion of said magnetic element.

6. The device according to claim 1, further comprising a base plate formed integral to or fixed to one of said right-angled elements on an underside thereof, and a support foot attached to a surface for contact with the floor, said surface having an end portion that extends out towards one of the plates of said right-angled element to provide contact and support for a glass panel from the underside.

7. The device according to claim 6, wherein said foot has a ribbed form to act as a male element for insertion and fixation in appropriate grooves in an extruded element, positioned under said base plate.

8. The device according to claim 7, wherein the extruded element is aluminum.

9. The device according to claim 1, further comprising a hinged element at one of the right-angled elements, and a base plate with a respective support foot at the other right-angled element.

10. The device according to claim 9, wherein said hinged element comprises two wing plates pivoting on a pin, wherein a first wing plate is fixed to the respective plate of the right-angled element to which it is associated and a second wing plate is intended for gluing to a respective glass panel.

11. The device according to claim 9, wherein said base plate is formed integral to or fixed to the respective right-angled element on an underside, and has an end portion that extends out towards the plate of said right-angled element to provide support for a glass panel from the underside.

12. The device according to claim 9, wherein said foot has a ribbed form to act as a male element for insertion and fixation in appropriate grooves in an extruded element positioned under said base plate.

13. The device according to claim 12, wherein the extruded element is aluminum.

14. The device according to claim 1, further comprising a cover element.

15. A device for supporting glass panels in a substantially perpendicular position to each other, the device comprising:

a block having a plate intended to be glued to a first glass panel;

at least one structurally separate right-angled element having a plate intended for gluing to a second glass panel and an appendix perpendicular to said plate; and means for adjustable fixation of said at least one right-angled element to said block, wherein said means for adjustable fixation comprises an elongated slot provided on said appendix of each said right-angled element and a fixing screw passing with its shank through said elongated slot, said fixing screw being associated with a nut that slides along longitudinal guides formed inside a cavity in said block.

16. The device according to claim 15, wherein the device further comprises a hinged element comprising two wing plates pivoting on a pin, wherein a first wing plate is fixed to the plate of the block or right angled element and a second wing plate is intended for gluing to a respective glass panel.

17. The device according to claim 15, wherein the device further comprises a magnetic element fixed to the plate of said block or right angled element in an appropriate seat formed in the block or right angled element, and a metal plate intended for fixation to a respective glass panel, said metal plate also having a hole for the insertion of said magnetic element.

18. The device according to claim 15, wherein the device further comprises a base plate formed integral to or fixed to one of said right-angled elements on an underside thereof, and a support foot attached to a surface for contact with the floor, said surface having an end portion that extends out towards the plate of said right-angled element to provide contact and support for a glass panel from the underside.

19. The device according to claim 15, wherein the device further comprises a hinged element at one of the right-angled elements, and a base plate with a respective support foot at another of the right-angled elements the other right-angled element.

20. The device according to claim 19, wherein said hinged element comprises two wing plates pivoting on a pin, wherein a first wing plate is fixed to the plate of the right-angled element to which the hinged element is associated and a second wing plate is intended for gluing to a respective glass panel.

21. The device according to claim 19, wherein said base plate is formed integral to or fixed to the respective right-angled element on the underside, and has an end portion that extends out towards the plate of said right-angled element to provide support for a glass panel from the underside.

22. A device for supporting glass panels in a substantially perpendicular position to each other, the device comprising:

a block having a plate intended to be glued to a first glass panel;

a structurally separate first right-angled element having a plate intended for gluing to a second glass panel;

a second right-angled element having a plate intended for gluing to a third glass panel; and means for adjustable fixation of said right-angled elements to said block, such that the respective plates of the right-angled elements are substantially perpendicular to one another and to said plate of the block, wherein said block comprises a turret terminating at one end with said plate and having an internal hollow cavity open at the rear and laterally on two sides perpendicular to each other through openings extending longitudinally;

wherein each said right-angled element comprises said plate and an appendix perpendicular to said plate; and wherein said means for adjustable fixation comprises an elongated slot provided on said appendix of each said right-angled element and a fixing screw passing with its shank through said elongated slot, said fixing screw being associated with a nut that slides along longitudinal guides formed inside the internal hollow cavity of the block.

* * * * *